US005264336A

United States Patent [19]

Marchetti et al.

[11] Patent Number: 5,264,336

[45] Date of Patent: Nov. 23, 1993

[54] SILVER BROM(OIOD)IDE EMULSIONS OF INCREASED SENSITIVITY IN THE NEAR INFRARED

[75] Inventors: Alfred P. Marchetti, Penfield; Ralph W. Jones, Jr., Hilton; Myra T. Olm, Webster, al of N.Y.

[73] Assignee: Eastman Kodak Company, Rochester, N.Y.

[21] Appl. No.: 682,998

[22] Filed: Apr. 10, 1991

[51] Int. Cl.[5] ..... G03C 1/035; G03C 1/12

[52] U.S. Cl. ..... 430/567; 430/570; 430/584; 430/603; 430/605; 430/944

[58] Field of Search ..... 430/567, 569, 570, 584, 430/603, 605, 944

[56] References Cited

U.S. PATENT DOCUMENTS

| | | | |
|---|---|---|---|
| 3,790,390 | 2/1974 | Shiba et al. | 430/567 |
| 3,890,154 | 6/1975 | Ohkubu et al. | 430/434 |
| 4,147,542 | 5/1979 | Habu et al. | 430/346 |
| 4,770,961 | 9/1988 | Tanaka et al. | 430/584 |
| 4,937,180 | 6/1990 | Marchetti et al. | 430/567 |
| 4,975,362 | 12/1990 | Parton et al. | 430/584 |
| 5,037,732 | 8/1991 | McDugle et al. | 430/567 |
| 5,132,203 | 7/1992 | Bell et al. | 430/567 |

*Primary Examiner*—Janet C. Baxter
*Attorney, Agent, or Firm*—Carl O. Thomas

[57] ABSTRACT

A photographic emulsion is disclosed in which an infrared spectral sensitizing dye is adsorbed to the surface of silver bromide grains optionally containing iodide. The grains are formed in the presence of a hexacoordination complex of iron and at least three cyanide ligands to counteract dye desensitization.

7 Claims, 1 Drawing Sheet

SILVER BROM(OIOD)IDE EMULSIONS OF INCREASED SENSITIVITY IN THE NEAR INFRARED

FIELD OF THE INVENTION

The invention relates to silver halide photography. The invention relates more specifically to infrared sensitized silver halide emulsions.

BACKGROUND OF THE INVENTION

Silver bromide and silver bromoiodide emulsions, hereinafter collectively referred to as silver brom(oiod-)ide emulsions, possess native imaging sensitivity in the ultraviolet and blue portions of the electromagnetic spectrum. Spectral sensitizing dyes have been developed to extend the imaging response of silver brom(oiod)ide throughout the visible spectrum.

With the emergence of solid state lasers as useful tools for photographic imaging applications a problem has arisen. Attempts to construct solid state lasers that emit in the visible spectrum have demonstrated that the efficiencies of solid state lasers drop sharply as emission wavelengths approach the visible. While there are many types of lasers that emit in the visible spectrum, their comparatively large and cumbersome constructions have rendered them unattractive. As a consequence, a significant need has arisen for silver halide photographic materials that are sensitive to the near infrared portion of the spectrum and, specifically, compatible with solid state laser exposure sources. As employed herein the term "near infrared" employed to indicate the 700 to 1500 nm wavelength range of the electromagnetic spectrum.

The problem that has been encountered is that the spectral sensitizing dyes that are capable of extending the photographic response of silver halide emulsions into the near infrared portion of the spectrum also desensitize the emulsions.

Dye desensitization is generally recognized and understood by those familiar with spectrally sensitized silver halide emulsions. Nevertheless, some elaboration is offered, since it is not intuitively obvious that a silver halide emulsion that shows no response to near infrared exposure in the absence of a spectral sensitizing dye, but responds in the presence of the dye, has been desensitized. Mees, *The Theory of the Photographic Process*, 3rd Ed., Macmillan, 1966, at page 257, explains dye desensitization and its verification. When silver halide grains are chemically sensitized, the speed of the emulsion is increased at all wavelengths. Other materials placed in or on the grains desensitize the emulsion at all wavelengths and are referred to as desensitizers. Spectral sensitizing dyes extend the sensitivity of the grains to wavelengths to which the grains lack native sensitivity, but often additionally reduce the sensitivity of the grains in the spectral region of native sensitivity. The reduction of sensitivity imparted by the dye provides an indirect indication that the dye is also reducing sensitivity in the region of spectral sensitization. The generally accepted theory stated by Mees and indicated to be consistent with results obtained by its application is that at any instant of exposure, only a minute fraction of the dye molecules on any grain are in the excited state, with the remaining, unexcited dye molecules remaining capable of adversely affecting grain sensitivity independently of the excited molecules.

Spectral sensitizing dyes are almost universally polymethine dyes, dyes that contain a chromophore extending between two terminal nuclei through a conjugated methine linkage with individual methine groups being optionally replaced with aza (—N=) linkages. While nuclei and substituent selections can influence the absorption wavelengths of the dye, polymethine dyes with absorption peaks in the blue, green, red and near infrared portions of the spectrum most notably differ in the length of their conjugated linkages between nuclei. Typically five or more methine groups join the nuclei of of polymethine dyes that exhibit an absorption peak at wavelengths greater than 700 nm. Under the topic Structure and Densensitization Mees at page 259 states, "In a given series of polymethine dyes, an increase in the length of the chain connecting the nuclei produces a rapid increase in the desensitizing effect."

It is therefore apparent that silver halide emulsions sensitized to the near infrared exhibit marked desensitization and that the increasing use of near infrared solid state lasers has increased the need for near infrared sensitized photographic emulsions exhibiting reduced dye desensitization.

PRIOR ART

Marchetti et al U.S. Pat. No. 4,937,180 recognized that formation of silver brom(oiod)ide grains in the presence of a hexacoordination complex of rhenium, ruthenium, or osmium with at least four cyanide ligands would increase the stability of the emulsions and reduce low intensity reciprocity failure.

Shiba et al U.S. Pat. No. 3,790,390, Ohkubo et al U.S. Pat. No. 3,890,154, and Habu et al U.S. Pat. No. 4,147,542 disclose emulsions particularly adapted to imaging with flash (less than $10^5$ second) exposures. Polymethine cyanine and merocyanine dyes are disclosed having up to three methine groups joining their nuclei with blue flash exposures being suggested with zero, one or two methine linking groups and green flash exposures being suggested with three methine linking groups. In addition to the dyes it is suggested to incorporate in the emulsions compounds of Group VIII metals—i.e., iron, cobalt, nickel, ruthenium, rhodium, palladium, osmium, iridium and platinum. Iron compounds suggested for incorporation are ferrous sulfate, ferric chloride, potassium hexacyanoferrate (II) or (III), and ferricyanide.

SUMMARY OF THE INVENTION

In one aspect this invention is directed to a photographic emulsion comprised of radiation-sensitive silver bromide grains optionally containing iodide and a spectral sensitizing dye adsorbed to the surface of the grains.

The emulsions are characterized in that the spectral sensitizing dye is a polymethine dye exhibiting an absorption peak in the near infrared spectral region of from 700 to 1500 nm and the grains exhibit a face centered cubic crystal lattice structure formed in the presence of a hexacoordination complex of iron and at least three cyanide ligands.

It has been discovered that the incorporation of a hexacoordination complex of iron containing at least three cyanide ligands increases the sensitivity of the emulsion when exposed in the near infrared portion of the spectrum as compared to the sensitivity that is realized in its absence. Further, it has been observed and demonstrated that the effect is dependent upon the selection of cyanide ligands for the hexacoordination complex. When an iron halide is substituted, the effect is to add to the desensitization of the emulsion attributable to the near infrared spectral sensitizing dye alone.

An important feature of the invention is that coordinating the cyanide ligands with iron eliminates any necessity of incorporating into the emulsions of the invention the heavier Group VIII metals of Periods 5 and 6. This allows a light, common metal to be employed for grain doping that is an ideal choice from an ecological compatibility viewpoint.

DESCRIPTION OF PREFERRED EMBODIMENTS

Figure 1:
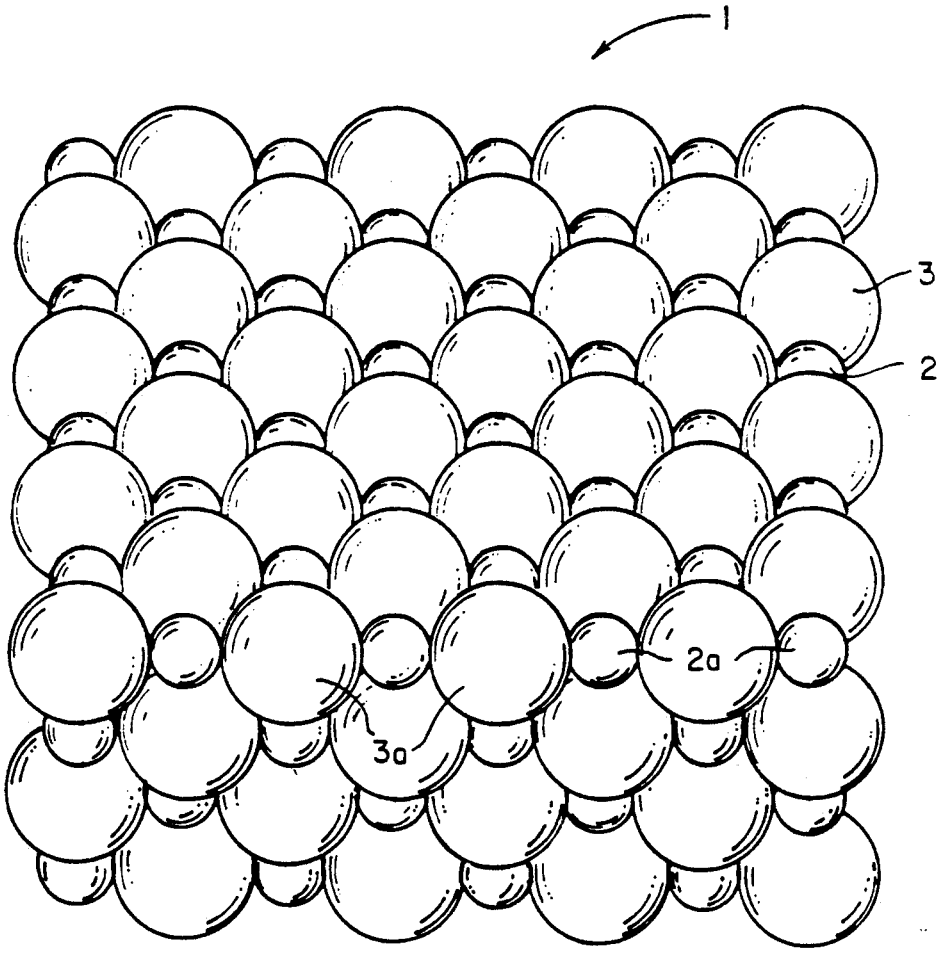
FIG. 1 is a schematic view of a silver bromide crystal structure with the upper layer of ions lying along a {100} crystallographic plane.

The present invention is directed to near infrared sensitized silver bromide and bromoiodide emulsions, collectively referred to as silver brom(oiod)ide emulsions, which exhibit increased sensitivity. Such emulsions contain bromide optionally in combination with iodide up to its solubility limit in silver bromide—that is, up to about 40 mole percent, based on total silver. Typically iodide is present in silver bromoiodide grains in concentrations ranging from 0.1 to 20 mole percent, most commonly from about 1 to 10 mole percent.

It has been discovered that dye desensitization attributable to the polymethine spectral sensitizing dye or dyes used to impart infrared sensitivity can be offset when the grains of the emulsion are formed in the presence of a hexacoordination complex of iron having three or more cyanide ligands.

The hexacoordinated complexes containing iron and cyanide ligands can be represented by the following formula:

$$[Fe(CN)_{6-y}L_y]^n \quad (I)$$

where

L is a bridging ligand, y is the integer zero, 1, 2 or 3, and n is −3 or −4.

It is in fact believed that the entire hexacoordinated transition metal complex is incorporated intact in the grains being formed. To understand how this can be possible, it is helpful to first review the structure of silver halide grains. Unlike silver iodide, which commonly forms only $\beta$ and $\gamma$ phases and is rarely used in photography, each of silver chloride and silver bromide form a face centered cubic crystal lattice structure of the rock salt type. In FIG. 1 four lattice planes of a crystal structure 1 of silver ions 2 and bromide ions 3 is shown, where the upper layer of ions lies in a {100} crystallographic plane. The four rows of atoms shown counting from the bottom of FIG. 1 lie in a {100} crystallographic plane which perpendicularly intersects the {100} crystallographic plane occupied by the upper layer of ions. The row containing silver ions 2*a* and bromide ions 3*a* lies in both intersecting planes. In each of the two {100} crystallographic planes it can be seen that each silver ion and each bromide ion lies next adjacent to four bromide ions and four silver ions, respectively. In three dimensions then, each interior silver ion lies next adjacent to six bromide ions, four in the same {100} crystallographic plane and one on each side of the plane. A comparable relationship exists for each interior bromide ion.

The manner in which a hexacoordinated transition metal complex can be incorporated in the grain structure can be roughly appreciated by considering the characteristics of a single silver ion and six adjacent halide ions (hereinafter collectively referred to as the seven vacancy ions) that must be omitted from the crystal structure to accommodate spatially the hexacoordinated iron complex. The seven vacancy ions exhibit a net charge of −5. This suggests that anionic iron complexes should be more readily incorporated in the crystal structure than neutral or cationic transition metal complexes. This also suggests that the capability of a hexacoordinated iron complex to trap either photogenerated holes or electrons may be determined to a significant degree by whether the complex introduced has a net charge more or less negative than the seven vacancy ions it displaces. This is an important departure from the common view that transition metals are incorporated into silver halide grains as bare ions or atoms and that their hole or electron trapping capability is entirely a function of their oxidation state.

Referring to FIG. 1, it should be further noted that the silver ions are much smaller than the bromide ions, though silver lies in the 5th period while bromine lies in the 4th period. Further, the lattice is known to accommodate iodide ions (in concentrations of up to 40 mole percent, noted above) which are still larger than bromide ions. Thus, the ions of iron, which is 4th period metal, are small enough to enter the lattice structure with ease. A final observation that can be drawn from the seven vacancy ions is that the six halide ions exhibit an ionic attraction not only to the single silver ion that forms the center of the vacancy ion group, but are also attracted to other adjacent silver ions.

Hexacoordinated complexes exhibit a spatial configuration that is compatible with the face centered cubic crystal structure of photographically useful silver halides. The six ligands are spatially comparable to the six halide ions next adjacent to a silver ion in the crystal structure. To appreciate that a hexacoordinated iron complex having ligands other than halide ligands can be accommodated into silver halide cubic crystal lattice structure it is necessary to consider that the attraction between the transition metal and its ligands is not ionic, but the result of covalent bonding, the latter being much stronger than the former. Since the size of a hexacoordinated complex is determined not only by the size of the atoms forming the complex, but also by the strength of the bonds between the atoms, a hexacoordinated complex can be spatially accommodated into a silver halide crystal structure in the space that would otherwise be occupied by the seven vacancy ions, even though the number and/or diameters of the individual atoms forming the complex exceeds that of the vacancy ions. This is because the covalent bond strength can significantly reduce the bond distances and therefore the size of the entire complex. Thus, the multielement ligands of hexacoordinated iron complexes can be spatially accommodated to single halide ion vacancies within the crystal structure.

Hexacoordination complexes satisfying the requirements of this invention are those which contain iron and 3, 4, 5 or 6 cyanide ligands. When less than 6 cyanide ligands are employed, the remaining ligands or ligand can be any convenient conventional bridging ligand. The latter when incorporated in the silver halide crystal structure are capable of serving as bridging groups between two or more metal centers. These bridging ligands can be either monodentate or ambidentate. A monodentate bridging ligand has only one ligand atom that forms two (or more) bonds to two (or more) different metal atoms. For monoatomic ligands and for those containing only one donor atom, only the monodentate form of bridging is possible. Multielement ligands with more than one donor atom can also function in a bridging capacity and are referred to as ambidentate ligands. Preferred bridging ligands are monoatomic monodentate ligands, such as halides. Fluoride, chloride, bromide and iodide ligands are all specifically contemplated. Multielement ligands, such as azide and thiocyanate ligands, are also specifically contemplated. Bridging ligands can be selected from among those disclosed for the transition metals disclosed by Janusonis et al U.S. Pat. No. 4,835,093, McDugle et al U.S. Pat. No. 4,933,272, Marchetti et al U.S. Pat. No. 4,937,180 and Keevert et al U.S. Pat. No. 4,945,035, the disclosures of which are here incorporated by reference. Bridging ligands which are desensitizers should, of course, be avoided.

Any net ionic charge exhibited by the hexacoordinated iron complexes contemplated for grain incorporation is compensated by a counter ion to form a charge neutral compound. The counter ion is of little importance, since the complex and its counter ion or ions dissociate upon introduction into an aqueous medium, such as that employed for silver halide grain formation. Ammonium and alkali metal counterions are particularly suitable for anionic hexacoordinated complexes satisfying the requirements of this invention, since these cations are known to be fully compatible with silver halide precipitation procedures.

The hexacoordination iron complexes can be incorporated in the emulsions in any concentration effective to reduce dye desensitization. Adjustments of concentrations for optimum response for a specific application are a routine undertaking in preparing photographic emulsions. It is generally preferred to form the grains in the presence of from $10^{-4}$ to 0.1 mole percent (preferably $10^{-3}$ to $10^{-2}$ mole percent) of the hexacoordination iron complex, based on final silver-that is, the based on the amount of silver in the grains as fully formed.

Procedures for beginning with the compounds of formula (I) above and preparing photographic silver halide emulsions benefitted by their incorporation can be readily appreciated by considering the prior teachings of the art relating to introducing transition metal dopants in silver halide grains. Such teachings are illustrated by Wark U.S. Pat. No. 2,717,833; Berriman U.S. Pat. No. 3,367,778; Burt U.S. Pat. No. 3,445,235; Bacon et al U.S. Pat. No. 3,446,927; Colt U.S. Pat. No. 3,418,122; Bacon U.S. Pat. No. 3,531,291; Bacon U.S. Pat. No. 3,574,625; Japanese Patent (Kokoku) 33781/74 (priority May 10, 1968); Japanese Patent (Kokoku) 30483/73 (priority Nov. 2, 1968); Ohkubo et al U.S. Pat. No. 3,890,154; Spence et al U.S. Pat. Nos. 3,687,676 and 3,690,891; Gilman et al U.S. Pat. No. 3,979,213; Motter U.S. Pat. No. 3,703,584; Japanese Patent (Kokoku) 32738/70 (priority Oct. 22, 1970); Shiba et al U.S. Pat. No. 3,790,390; Yamasue et al U.S. Pat. No. 3,901,713; Nishina et al U.S. Pat. No. 3,847,621; *Research Disclosure*, Vol. 108, April 1973, Item 10801; Sakai U.S. Pat. No. 4,126,472; Dostes et al Defensive Publication T962,004 and French Patent 2,296,204; U.K. Specification 1,527,435 (priority Mar. 17, 1975); Japanese Patent Publication (Kokai) 107,129/76 (priority Mar. 18, 1975); Habu et al U.S. Pat. Nos. 4,147,542 and 4,173,483; *Research Disclosure*Vol. 134, June 1975, Item 13452; Japanese Patent Publication (Kokai) 65,432/77 (priority Nov. 26, 1975); Japanese Patent Publication (Kokai) 76,923/77 (priority Dec. 23, 1975); Japanese Patent Publication (Kokai) 88,340/77 (priority Jan. 26, 1976); Japanese Patent Publication (Kokai) 75,921/78 (priority Dec. 17, 1976); Okutsu et al U.S. Pat. No. 4,221,857; Japanese Patent Publication (Kokai) 96,024/79 (priority Jan. 11, 1978); *Research Disclosure*, Vol. 181, May 1979, Item 18155; Kanisawa et al U.S. Pat. No. 4,288,533; Japanese Patent Publication (Kokai) 25,727/81 (priority Aug. 7, 1979); Japanese Patent Publication (Kokai) 51,733/81 (priority Oct. 2, 1979); Japanese Patent Publication (Kokai) 166,637/80 (priority Dec. 6, 1979); and Japanese Patent Publication (Kokai) 149,142/81 (priority Apr. 18, 1970); the disclosures of which are here incorporated by reference.

Apart from the features specifically described above, the grains and their formation can take any convenient conventional form, as illustrated by *Research Disclosure*, Vol. 308, December 1989, Item 308119, Section I. *Research Disclosure* is published by Kenneth Mason Publications, Ltd., Dudley Annex, 21a North Street, Emsworth, Hampshire P010 7DQ, England. The emulsions once formed can be washed and chemically sensitized as illustrated by Sections II and III of *Research Disclosure* Item 308119.

Near infrared spectral sensitization of the iron-cyanide complex doped grains can be undertaken by any convenient conventional procedure. The near infrared spectral sensitizers are polymethine dyes containing extended conjugated methine linkages separating their terminal nuclei. The near infrared spectral sensitizing dyes contemplated for incorporation in the emulsions of this invention the following relationship:

$$Nuc^1—(—E=)_e=Nuc^2 \quad (II)$$

where $Nuc^1$ is a first polymethine dye nucleus;

$Nuc^2$ is a second polymethine dye nucleus;

E is an aza or methine linking unit; and e is an integer of at least 5 (preferably at least 7) up to 25 or more (preferably up to 15).

To exhibit an absorption peak in the near infrared—that is, at a wavelength of 700 nm or longer—the polymethine linkage must have the length of at least a dicarbocyanine dye—i.e., at least five conjugated —E= linking units. In their simplest form the —E= linking units are methine linking units, —CR=, where R is typically hydrogen, alkyl of from 1 to 3 carbon atoms or phenyl. It is, of course, recognized by Hamer, *The Cyanine Dyes and Related Compounds*, Interscience Publishers, 1964, Chapter IX. Cyanines in which the Odd-Numbered Carbon Chain, which Links the Nuclei, or Part of it, is Cyclic, that adjacent methine substituents R can be joined to form cyclic structures. It is also observed by Hamer, Chapter XII. Azacyanines, Including Dyes Substituted on the Chain, and Bases of which the Quaternary Salts are Azacyanines, that instead of being a methine linking unit, —E= can represents an aza, —N=, linking unit.

In the preferred polymethine dyes at least $Nuc^1$ is a basic nucleus of the type found in a cyanine dye. When the second nucleus, $Nuc^2$, is also a basic nucleus of the type found in a cyanine dye, the spectral sensitizing dye is a dicarbocyanine (e is 5), tricarbocyanine (e is 7), tetracarbocyanine (e is 9), heptacarbocyanine (e is 11) or a further extended conjugated methine linkage homologue.

By alternative choices of the second nucleus the polymethine dyes can be selected from a wide variety of classes. When $Nuc^2$ is an acidic nucleus, the polymethine dye is a merocyanine. Since merocyanine dyes contain an even number of —E= linking units between their nuclei, the minimum value of the integer "e" in (II) above is 6. In other words, the merocyanine dyes contemplated for use in the invention are hexamethine merocyanines, their aza analogues and their extended conjugated methine linkage homologues.

Still other selections of the second nucleus are possible. The various nuclei disclosed by Gunther et al U.S. Pat. No. 4,576,905, the disclosure of which is here incorporated by reference, for use with tellurazole nuclei are all illustrations of varied $Nuc^2$ selections. The spectral sensitizing dyes disclosed by Kofron et al U.S. Pat. No. 4,439,520, the disclosure of which is here incorporated by reference, modified to increase the conjugated methine linkage to 5 or more units, can be employed in the practice of this invention.

Typical useful near infrared spectral sensitizing dyes are described, for example, in Trivelli et al U.S. Pat. No. 2,245,236; Brooker U.S. Pat. Nos. 2,095,854 and 2,095,856; Dieterle U.S. Pat. No. 2,084,436; Zeh U.S. Pat. No. 2,104,064; Konig U.S. Pat. No. 2,199,542; Brooker et al U.S. Pat. No. 2,213,238; Heseltine U.S. Pat. Nos. 2,734,900 and 3,582,344; Barth et al U.S. Pat. No. 2,134,546; Brooker U.S. Pat. No. 2,186,624; Schneider U.S. Pat. No. 2,073,759; Thompson U.S. Pat. No. 2,611,695; Brooker et al U.S. Pat. No. 2,955,939; Jenkins et al 3,573,921; Jeffreys U.S. Pat. No. 3,552,974; and Fumia et al U.S. Pat. Nos. 3,482,978; 3,623,881 and 3,652,288; the disclosures of which are here incorporated by reference.

Apart from the emulsion features described above, the emulsions and photographic elements for their use can take any of a wide variety of conventional forms. These features are surveyed in *Research Disclosure*, Item 308119, cited above and here incorporated by reference.

EXAMPLES

The invention can be better appreciated by reference to the following specific examples. The term "IR" is employed to mean "near infrared" as defined above.

EXAMPLE 1

The purpose of this example is to demonstrate the utility of an incorporated hexacoordination iron complex containing cyanide ligands to reduce desensitization by near infrared polymethine spectral sensitizing dye adsorbed on {111} grain surfaces—i.e., octahedral grain surfaces. This examples further illustrates that incorporation of the cyanide ligand is essential by showing that $FeCl_3$ when substituted for hexacoordination iron complex containing cyanide ligands reduces sensitivity. Six solutions were prepared as follows:

| | |
|---|---|
| Solution 1 (1) | |
| Gelatin (bone) | 50 gm |
| D. W. | 2000 mL |
| Solution 2 (1) | |
| Sodium bromide | 10 gm |
| D. W. | 100 mL |

-continued

| | |
|---|---|
| Solution 3 (1) | |
| Sodium bromide | 412 gm |
| D. W. to total volume | 1600 mL |
| Solution 4 (1) | |
| Silver nitrate (5 Molar) | 800 mL |
| D. W. to total volume | 1600 mL |
| Solution 5 (1) | |
| Gelatin (phthalated) | 50 gm |
| D. S. | 300 mL |
| Solution 6 (1) | |
| Gelatin (bone) | 130 mL |
| D. W. | 400 mL |

Solution 1 (1) was adjusted to a pH of 3.0 with nitric acid at 40° C. The temperature of solution 1 (1) was adjusted to a 70° C. Solution 1 (1) was then adjusted to a pAg of 8.2 with solution 2 (1). Solutions 3 (1) and 4 (1) were simultaneously run into the adjusted solution 12 (1) at a constant rate for the first 4 minutes with introduction being accelerated for the next 40 minutes. The addition rate was held constant over a final 2-minute period for a total addition time of 46 minutes. The pAg was maintained at 8.2 over the entire run. After the addition of solutions 3 (1) and 4 (1), the temperature was adjusted to 40° C., the pH was adjusted to 4.5, and solution 5 (1) was added. The mixture was then held for 5 minutes, after which the pH was adjusted to 3.0 an the gel allowed to settle. At the same time the temperature was dropped to 15° C. before decanting the liquid layer. The depleted volume was restored with distilled water. The pH was readjusted at 4.5, and the mixture held at 40° C. for ½ hour before the pH was adjusted to 3.0 and the settling and decanting ting steps were repeated. Solution 6 (1) was added, and the pH and pAg were adjusted to 5.6 and 8.2, respectively. This emulsion (1U) was digested with 3 mg per Ag mole of $Na_2S_2O_3.5H_2O$ and 2 mg per Ag mole $KAuCl_4$ for 30 minutes at 70° C. Coatings were made at 27 mg Ag/dm$^2$ and 86 mg gelatin/dm$^2$. The coatings were exposed with an EG&G TM sensitometer at $10^{-4}$ sec with a Wratten TM 87 filter. Exposed coatings were developed for 6 min in a standard developer containing Elon TM (N-methyl-p-aminophenol hemisulfate), hydroquinone, $Na_2SO_3$, KBr and buffered to a pH of 10.5.

A second emulsion (1D) was prepared with $K_4Fe(CN)_6$ at a formal concentration of 42 molar parts per million added in the salts after the first 5 min and ended when ¾ of the reagents had been added. This emulsion was digested and prepared as emulsion 1U.

Four IR absorbing dyes have been used and their structures are shown in Table 1(6).

The two emulsions 1U and 1D were coated with 3 levels of an IR absorbing cyanine dye, DYE 4 as shown in Table 1(1). The speed enhancing effect for equivalent exposure and processing is shown as a percentage speed increase [(speed doped-speed undoped)/speed undoped]×100.

TABLE 1(1)

| Level | Speed % |
|---|---|
| 0.02 millimole/Ag mole | 35% |
| 0.04 | 29% |
| 0.06 | 35% |

EXAMPLE 1B

The two emulsions 1U and 1D were coated with 3 levels of the IR cyanine dye, DYE 2. The speed enhancing effect of the doped emulsion is shown as a percentage increase in speed as shown in Table 1(2)

TABLE 1(2)

| Level | Speed % |
|---|---|
| 0.02 millimole/Ag mole | 70% |
| 0.04 | 91% |
| 0.06 | 35% |

A third emulsion (1F) was prepared with $FeCl_3$ at a formal concentration of 50 molar parts per was digested and prepared as emulsion 1U.

EXAMPLE 1C

The two emulsions 1U and 1F were coated with two levels of an IR adsorbing dye, DYE 4 as shown in Table 1(3).

TABLE 1(3)

| Level | Speed % |
|---|---|
| 0.02 millimole/Ag mole | −48% |
| 0.04 | −46% |

EXAMPLE 1D

The two emulsions 1U and 1F were coated with two levels of an IR adsorbing dye, DYE 2 as shown in Table 1(4).

TABLE 1(4)

| Level | Speed % |
|---|---|
| 0.02 millimole/Ag mole | −63% |
| 0.04 | −57% |

EXAMPLE 1F

The two emulsions 1U and 1F were coated with two levels of an IR adsorbing dye, DYE 3 as shown in Table 1(5).

TABLE 1(5)

| Level | Speed % |
|---|---|
| 0.02 millimole/Ag mole | −35% |
| 0.04 | −50% |

The examples in Tables 1(3), 1(4) and 1(5) clearly show that $FeCl_3$ is a desensitizer in this system and does not improve speed with IR dyes

TABLE 1(6)

Dye structures

DYE 1

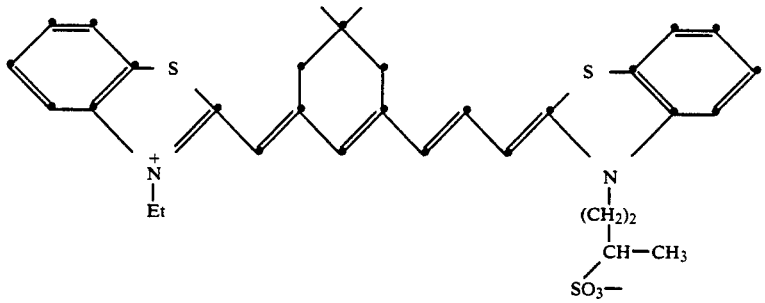

3-Ethyl,3'-(3-sulfobutyl)-9,11-neopentylenethiatricarbocyanine $\lambda_{max}$ = 765 nm (MeOH)

DYE 2

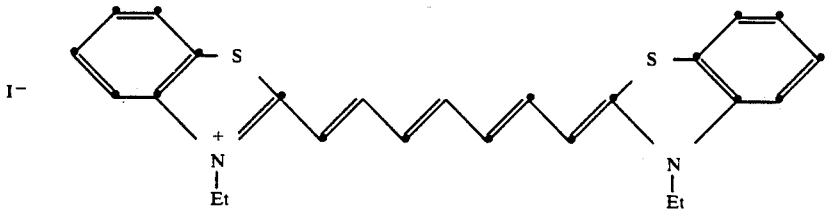

3,3'-Diethylthiatricarbocyanine, iodide counter ion $\lambda_{max}$ = 750 nm (MeOH)

TABLE 1(6)-continued

DYE 3

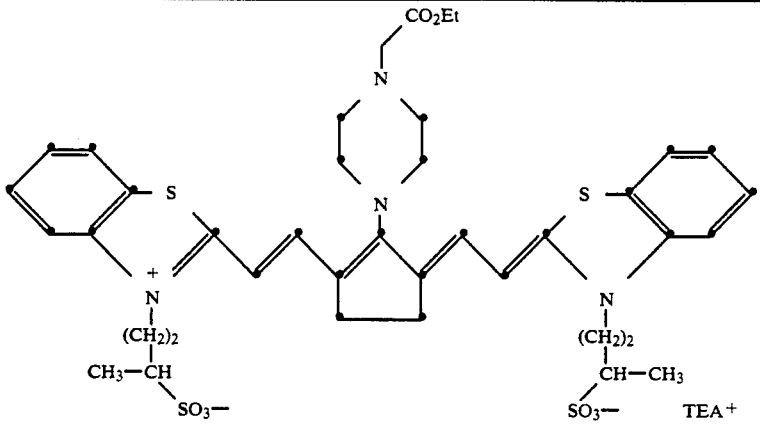

Anhydro-3,3'-bis(3-sulfobutyl)-11-(4-ethoxycarbonyl-1-piperazinyl)-10,12-ethylenethiatricarbocyanone, triethylamine (TEA) salt
$\lambda_{max}$ = 737 nm (MeOH)

DYE 4

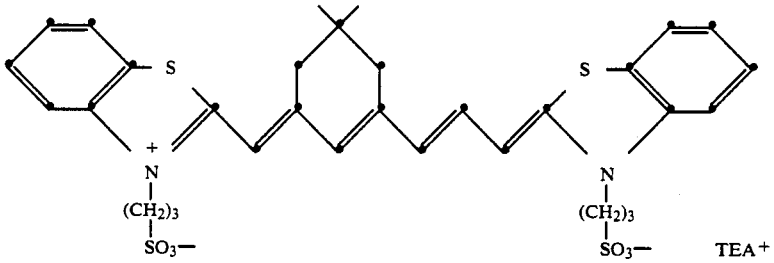

3,3'-Bis(3-sulfopropyl)-9,11-neopentylenethiatricarbocyanine, triethylamine salt
$\lambda_{max}$ = 764 nm (MeOH)

EXAMPLE 2

The purpose of this example is to demonstrate the utility of an incorporated hexacoordination iron complex containing cyanide ligands to reduce desensitization by near infrared polymethine spectral sensitizing dye adsorbed on {100} grain surfaces—i.e., cubic grain surfaces. This examples further illustrates that incorporation of the cyanide ligand is essential by showing that $FeCl_3$ when substituted for hexacoordination iron complex containing cyanide ligands reduces sensitivity.

Three solutions were prepared as follows:

| | |
|---|---|
| Solution 1 (2) | |
| Gelatin (bone) | 165 g |
| NaBr | 5.3 g |
| D. W. | 5500 mL |
| Solution 2 (2) | |
| NaBr | 1030 gm |
| D. W. to total vol | 5000 mL |
| Solution 3 (2) | |
| $AgNO_3$ (5 molar) | 2000 mL |
| D. W. to total vol | 5000 mL |

Solution 1(2) was adjusted to a pH of 4.0 at 40° C. The temperature of 1(2) was varied to 68° C. and the pAg measured to be 8.4. Solutions 2(2) and 3(2) were simultaneously run into 1(2) at a constant rate for the first 5 minutes. After 5 m in the flows were accelerated for the next 16 min. After 10% of the total silver nitrate had been run in, the pAg was lowered to 6.8. After the addition of 2(2) and 3(2) the temperature was adjusted to 40° C. and the emulsion was washed by ultrafiltration (*Research Disclosure*, Vol. 131, March, 1975, Item 13122). Make up gel was added and the pH and pAg were adjusted to 6.5 and 8.06, respectively. The emulsion (2U) was digested with 3 mg per Ag mole of $Na_2S_2O_3.5H_2O$ and 2 mg per Ag mole of $KAuCl_4$ for 10 min at 65° C. The digest temperature was ramped from 40° C. to 65° C. at about 2° C./min and ramped down to 40° C. at about 1.3° C./min. Various levels (see tables) of IR dyes were added along with 4-hydroxy-6-methyl-1,3,3a,7-tetraazaindine. Coatings were made at 27 mgAg/dm$^2$ and 86 mg gelatin/dm$^2$. The samples were exposed with an EG&G TM sensitometer at $10^{-4}$ sec with a Wratten TM 87 filter. Exposed coatings were developed for 3 or 6 min in a standard developer containing Elon TM, hydroquinone, $Na_2SO_3$, KBr and buffered to a pH of 10.5.

A second emulsion (2D) was prepared with $K_4Fe(CN)_6$ at a formal concentration of 50 molar parts million added in the salts after the first 5 min and ended when ¾ of the reagents had been added. This emulsion was digested and prepared as emulsion 2U.

EXAMPLE 2A

The two emulsions 2U and 2D were coated with 3 levels of an IR absorbing dicarbocyanine dye, DYE 4. The speed enhancing effect of the dopant is shown in Table 2(1) as a percentage speed increase.

TABLE 2(1)

| Level | Speed % |
|---|---|
| 0.02 millimole/Ag mole | 41% |
| 0.04 | 20% |
| 0.06 | 23% |

EXAMPLE 2B

The two emulsions 2U and 2D were coated with 3 levels of an IR absorbing dye, DYE 2. The speed enhancing effect of the dopant is shown in Table 2(2) as a percentage speed increase.

TABLE 2(2)

| Level | Speed % |
|---|---|
| 0.02 millimole/Ag mole | 45% |
| 0.04 | 38% |
| 0.06 | 29% |

EXAMPLE 2C

The two emulsions 2U and 2D were coated with 4 14levels of an IR absorbing dye, DYE 1. The speed enhancing effect of the dopant is shown as a percentage increase in Table 2(3).

TABLE 2(3)

| Level | Speed % |
|---|---|
| 0.0215 millimole/Ag mole | 51% |
| 0.043 | 23% |
| 0.0645 | 20% |
| 0.0860 | 26% |

EXAMPLE 2D

The two emulsions 2U and 2D were coated with 4 levels of an IR absorbing dye, DYE 3. The speed enhancing effect of the dopant is shown as a percentage increase in speed in Table 2(4).

TABLE 2(4)

| Level | Speed % |
|---|---|
| 0.02 millimole/Ag mole | 55% |
| 0.04 | 35% |
| 0.06 | 35% |
| 0.08 | 17% |

EXAMPLE 2E

The two emulsions 2U and 2D were coated with 4 levels of an IR absorbing cyanine dye, DYE 4. The speed enhancing effect of the dopant is shown in Table 2(5) as a percentage speed increase.

TABLE 2(5)

| Level | Speed % |
|---|---|
| 0.02 millimole/Ag mole | 58% |
| 0.06 | 29% |
| 0.08 | 51% |

A third emulsion (2F) was prepared with $FeCl_3$ at a formal concentration of 50 molar parts million added in the salts after the first 5 min and ended when $\frac{3}{4}$ of the reagents had been added. This emulsion was digested and prepared as emulsion 2U.

EXAMPLE 2F

The two emulsions 2U and 2F were coated with 2 levels of an IR dye, DYE 4, as shown in Table 2(6).

TABLE 2(6)

| Level | Speed % |
|---|---|
| 0.02 millimole/Ag mole | 7% |
| 0.04 | −7% |

EXAMPLE 2G

The two emulsions 2U and 2F were coated with 2 levels of an IR dye, DYE 2, as shown in Table 2(7).

TABLE 2(7)

| Level | Speed % |
|---|---|
| 0.02 millimole/Ag mole | 7% |
| 0.04 | 10% |

EXAMPLE 2H

The two emulsions 2U and 2F were coated with 2 levels of an IR dye, DYE 3, as shown in Table 2(8).

TABLE 2(8)

| Level | Speed % |
|---|---|
| 0.02 millimole/Ag mole | 15% |
| 0.04 | 7% |

The examples shown in Tables 2(6), 2(7) and 2(8) fail to demonstrate a beneficial effect from the use of $FeCl_3$ as a dopant with IR dyes, since the speed changes are within experimental variability.

The invention has been described in detail with particular reference to preferred embodiments thereof, but it will be understood that variations and modifications can be effected within the spirit and scope of the invention.

What is claimed is:

1. A photographic emulsion comprised of radiation-sensitive silver halide grains in which the silver halide consists essentially of silver bromide and a spectral sensitizing dye adsorbed to the surface of the grains, characterized in that the spectral sensitizing dye is a polymethine dye exhibiting an absorption peak in the near infrared spectral region of from 700 to 1500 nm and said grains exhibit a face centered cubic crystal lattice structure formed in the presence of a hexacoordination complex of iron and at least three cyanide ligands.

2. A photographic emulsion according to claim 1 further characterized in that said silver halide grains exhibit at least one of sulfur and gold surface sensitization.

3. A photographic emulsion according to claim 1 further characterized in that said hexacoordination complex satisfies the formula:

$$[Fe(CN)_{6-y}L_y]^n$$

where

L is a bridging ligand, y is the integer zero, 1, 2 or 3 and n is −3, or −4.

4. A photographic emulsion according to claim 3 further characterized in that L is a halide ligand.

5. A photographic emulsion according to claim 3 further characterized in that said hexacoordination complex satisfies the formula $$[Fe(CN)_6]^{-4}.$$

6. A photographic emulsion according to claim 3 further characterized in that said emulsion contains from $10^{-4}$ to 0.1 mole percent of the hexacoordination complex, based on silver.

7. A photographic emulsion according to claim 6 further characterized in that said emulsion contains from $10^{-3}$ to $10^{-2}$ mole percent of the hexacoordination complex, based on silver.

* * * * *